United States Patent [19]

Kao

[11] Patent Number: 4,476,771

[45] Date of Patent: Oct. 16, 1984

[54] SELF-FLUSHING PISTON ASSEMBLY FOR SLURRY PUMP

[75] Inventor: David T. Kao, Lexington, Ky.

[73] Assignee: University of Kentucky Research Foundation, Lexington, Ky.

[21] Appl. No.: 432,411

[22] Filed: Sep. 30, 1982

[51] Int. Cl.[3] ..... F15B 21/04; F01B 31/00; F16J 9/00

[52] U.S. Cl. ..... 92/78; 92/87; 92/129; 92/251

[58] Field of Search ..... 92/78, 87, 86.5, 129, 92/251

[56] References Cited

U.S. PATENT DOCUMENTS

| | | | |
|---|---|---|---|
| 2,144,662 | 1/1939 | Paasche | 92/78 |
| 2,787,126 | 4/1957 | Kleczek | 92/129 |
| 3,104,619 | 9/1963 | Swarthout | 92/87 |
| 3,146,940 | 9/1964 | McCrory et al. | 92/86.5 |
| 3,256,827 | 6/1966 | Smith | 92/86.5 |
| 3,266,435 | 8/1966 | Smith | 92/160 |
| 3,279,383 | 10/1966 | Smith | 92/87 |
| 3,818,807 | 6/1974 | Semple | 92/87 |
| 4,023,469 | 5/1977 | Miller | 92/87 |
| 4,157,057 | 6/1979 | Bailey | 92/87 |

FOREIGN PATENT DOCUMENTS

| | | | |
|---|---|---|---|
| 2853347 | 6/1980 | Fed. Rep. of Germany | 92/87 |
| 211936 | 4/1967 | Sweden | 92/251 |

*Primary Examiner*—Paul E. Maslousky
*Attorney, Agent, or Firm*—King and Liles

[57] ABSTRACT

A slurry pump is provided having a self-flushing piston assembly mounted in a mating cylinder. The piston assembly includes a first piston having a peripheral sealing member and a reciprocating piston rod for driving the first piston for pumping action. A second piston mounted adjacent to the first piston includes a sealing member and forms an enclosed chamber with the first piston. A lost motion coupler connects the pistons together and varies the size of the chamber. On the return stroke of the piston assembly, flushing liquid on the non-slurry side is sucked into the chamber as the chamber expands. On the power stroke, the flushing liquid is forced past the second sealing member to remove slurry particles and prevent wear of the cylinder. The disc on the first piston has sufficient flexibility to allow filling of the chamber and an accumulator is provided to control the back pressure after the chamber has been filled on the return stroke. The flexible sealing discs are mounted by retainer plates and the lost motion coupler includes a hollow carrier mating with a shoulder on the rod for limited reciprocating movement.

8 Claims, 3 Drawing Figures

SELF-FLUSHING PISTON ASSEMBLY FOR SLURRY PUMP

BACKGROUND OF THE INVENTION

The present invention relates to a slurry pump, and more particularly, to a piston assembly or head having an improved self-flushing feature.

BACKGROUND ART

As the price of petroleum and other liquid/gas fuels continues to increase, the use of coal becomes more and more economical and popular. In the past, shipping coal by railway, barge and trucks has sufficed for the relatively small quantities of coal being transported. However, as the use of coal increases, it becomes more and more important to provide more economic ways to transport this fuel. Of course, for many years, petroleum and petroleum products have been transported over literally hundreds of miles by pipelines. The pipelines are able to send massive volumes of fuel to the urban centers of the country and at a fraction of the cost of other transportation modes. With this in mind, it is not surprising that coal slurry pipelines that would transport coal suspended in water or other carrier liquid have been proposed. Indeed, there are successful slurry pipelines in operation today, mostly for conveying coal over a relatively short distance to a power plant from an adjacent mine.

One of the major drawbacks of a slurry pipeline, is the abrasive effect of the solid coal and rock particles on the pump. The particles tend to lodge between the pumping cylinder and the sealing lip of the piston head. When this happens, the particles scratch the surface of the cylinder, and under certain conditions can quickly wear the cylinder to where the piston no longer seals properly and pumping pressure is lost. In addition to damaging the cylinder wall, the flexible seals are also damaged and worn by the solid particles. When the pump is repaired, such as by inserting a new cylinder liner, the seals must also be replaced. Because of this, the pumps must be torn down on a regular schedule and repair or replacement of the cylinder wall and seals greatly increase the cost of operation. Solving this problem would greatly enhance the economic feasibility of long-distance slurry pipelines.

There have been proposals in the past for injecting a liquid into the pump to form a more efficient sealant for the piston. Inherently, if the metered sealant liquid, such as water, is fed at a sufficient pressure, the liquid will seep out around the seals on the piston and thus dislodge the solid particles before damage to the seals or cylinder liner can occur.

The proposals in the past for providing such a self-flushing piston have included relatively complicated structure designed to supply metered liquid supply to the periphery of the piston. One example of such a prior attempt to solve the problem is shown in the Semple U.S. Pat. No. 3,818,807. In this prior patent, a complicated trombone-type feeding tube is provided to feed the liquid into the back of the cylinder, inwardly to the piston rod, through the piston rod to the piston and then radially outward to the periphery of the piston. This particular arrangement, while working well in many applications, is expensive to manufacture and especially expensive to maintain. Additional seals must be provided and extreme caution must be taken to maintain the alignment of the feed tubes to insure constant liquid supply.

Other approaches have been to provide flexible tubing to feed the liquid to the back of the piston in a piston head. In this instance, elaborate control systems for providing the pressurized liquid must be employed and the tubes are subject to constant wear due to flexing. Again, this arrangement is relatively expensive and provides potential maintenance problems, such as with leaking along the feed tubes or at the coupling point for the feed tubes. This is proposed in the Swarthout U.S. Pat. No. 3,104,619. The potential problem with this arrangement is recognized and as an alternative embodiment the concept of providing a wide piston with a relatively limited stroke is suggested. Again, the cost is excessive due to the requirement, not only for the wide piston, but for the tubing and connections to be made to the cylinder.

DISCLOSURE OF THE INVENTION

Thus, with the above shortcomings in the art in focus, it is a primary object of the present invention to provide a simplified and more efficient manner of protecting the cylinder wall, as well as the sealing elements, in a slurry pump.

Another object of the invention is to provide a piston assembly capable of receiving injected flushing fluid and by the piston movement alone send flushing fluid flow around the sealing element to remove foreign particles.

Still another object of the present invention is to provide a slurry pump head wherein tandem pistons are coupled together so as to draw a flushing liquid into a variable volume chamber between the pistons during the suction or return stroke and eject the flushing fluid around the sealing periphery of the piston on the slurry side in order to remove the particles.

Also, an object of the present invention is to provide a tandem piston assembly, wherein one piston is mounted for lost motion to thereby form a chamber with a variable volume to receive the flushing fluid directly from pressure-controlled water or other liquid-on the back (non-slurry) side of the piston assembly.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved piston assembly is provided inducing the required particle flushing flow around the piston assembly due to the pumping and metering action of the assembly itself. The piston assembly, of course, is provided for mounting in a mating cylinder to form the pump. As the piston operates on the power stroke, the required amount of fluid, determined by the structure of the assembly itself, provides for peripheral flushing flow to thereby remove the particles and prevent wearing of the sealing member and the cylinder wall.

In the embodiment shown, the piston assembly includes a first piston having a peripheral sealing member, a second piston also including a peripheral sealing member and positioned adjacent the first piston and the pistons forming an enclosed chamber between. Reciprocating means drives the first piston for pumping action with the second piston being mounted for axial movement along the cylinder with lost motion relative to the first piston. Flushing liquid is automatically injected into the chamber during return stroke and expansion of the chamber. On the power stroke, the chamber is reduced in size and the high positive pressure forces the flushing liquid past the seal periphery of the second piston, which is positioned on the slurry side. Any particles tending to lodge or accumulate around the leading edge of the piston seal, will be promptly blown away by the substantial liquid pressure, thus assuring against the deleterious wear of the parts.

In the particular embodiment shown, the sealing member on the second piston (on the slurry side) is peripherally flooded with the flushing liquid to remove slurry particles. Since the particles are being ejected at a relatively high pressure generated in the captive chamber between the pistons, the particles are efficiently removed and wear is virtually eliminated.

In the preferred embodiment, the sealing members comprise respective first and second flexible discs peripherally deflected toward the slurry side. In order to insure injection of the flushing liquid into the chamber, the first disc is made with sufficient flexibility to allow entry of the liquid during the return stroke. The liquid is provided from a source on the non-slurry side of the piston assembly and is preferably designed to fill the cylinder in this area. A back pressure control arrangement, including an accumulater with a flexible diaphragm to receive the flushing liquid after the chamber is filled, minimizes the drag on the reciprocating means during the return stroke. This feature provides for minimum power being required to drive the piston.

Each piston includes a pair of retainer plates clamping the disc in position. In the first piston, the disc is clamped directly to the piston rod extending along the axis of the cylinder on the non-slurry side. The coupling means for the second piston includes a hollow carrier slidably receiving the end of the piston rod and with a shoulder on the rod for the required lost motion action.

Still other objects of the present invention will become readily apparent to those skilled in this art from the following description, wherein there is shown and described in more detail the preferred embodiment of this invention. This simply illustrates one of the modes best suited to carry out the invention, and as will be realized, the invention is capable of other different embodiments and the several details are capable of modifications in various, obvious aspects, all without departing from the invention. Accordingly, the drawings and descriptions should be regarded as illustrative in nature and not as restrictive.

BEST MODE OF CARRYING OUT THE INVENTION

Figure 1:
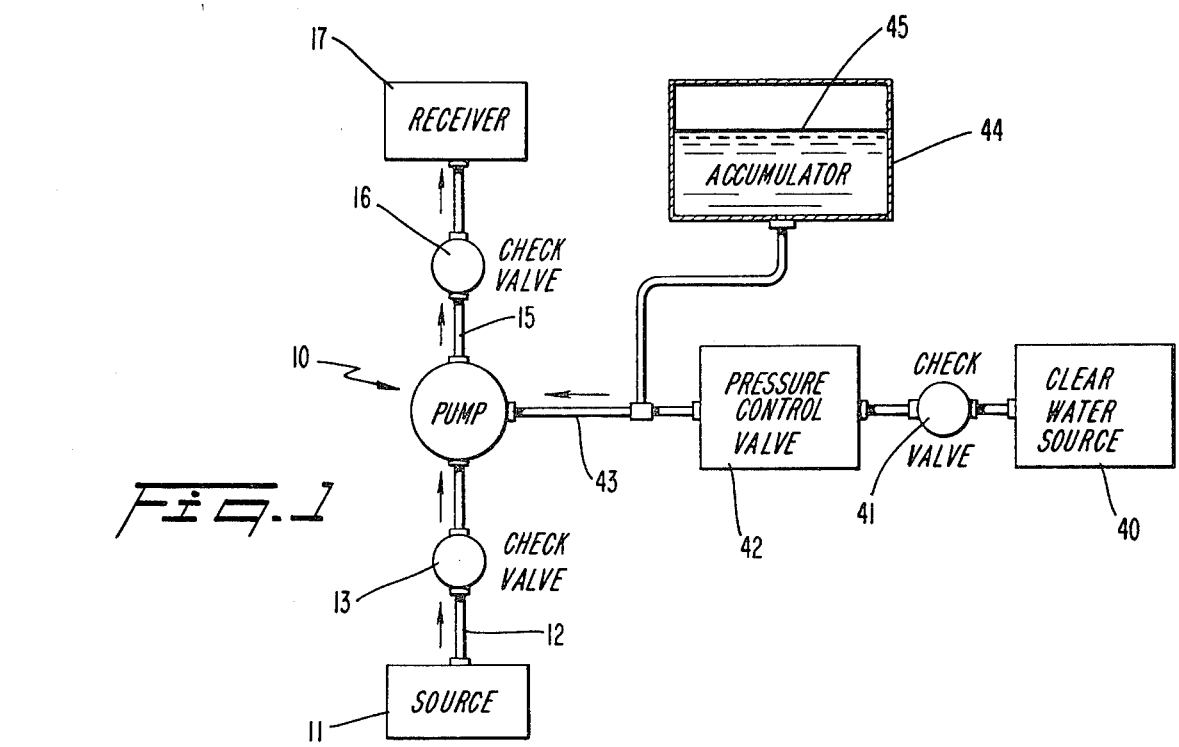
FIG. 1 is a schematic diagram of a slurry pump utilizing the feature of the piston assembly of the present invention.

Reference is now made to FIG. 1 illustrating a schematic diagram of a pumping system designed to utilize the improved piston assembly of the present invention. A pump 10 is designed to receive slurry from a source 11 transferred along a line 12 and through a check valve 13. On the pressure side of the pump, a pressure line 15 feeds the slurry through a check valve 16 to a suitable receiver 17, such as a holding tank. Of course, other subsequent operations can be performed on the slurry after the slurry is taken from the tank. Although the present pumping system is being described for handling coal slurry, and this is anticipated as being the primary application, it is clear that other types of aggregate suspended in a liquid can be pumped efficiently with the system.

The pump 10 includes a cylinder 20 and inside the cylinder is a piston assembly 21 constructed in accordance with the present invention to be self-flushing and thus prevent wear of the cylinder wall and the seals, as will be more readily apparent in the discussion below.

A first piston 25 includes a peripheral sealing member 26 in the form of a flexible disc peripherally deflected toward the slurry side. In this manner, the piston forms an effective pumping element toward the slurry side, as will be evident to persons skilled in the art viewing the drawing. The first piston 25 is mounted securely to piston rod 27 driven by reciprocating power means 28.

Figure 2:
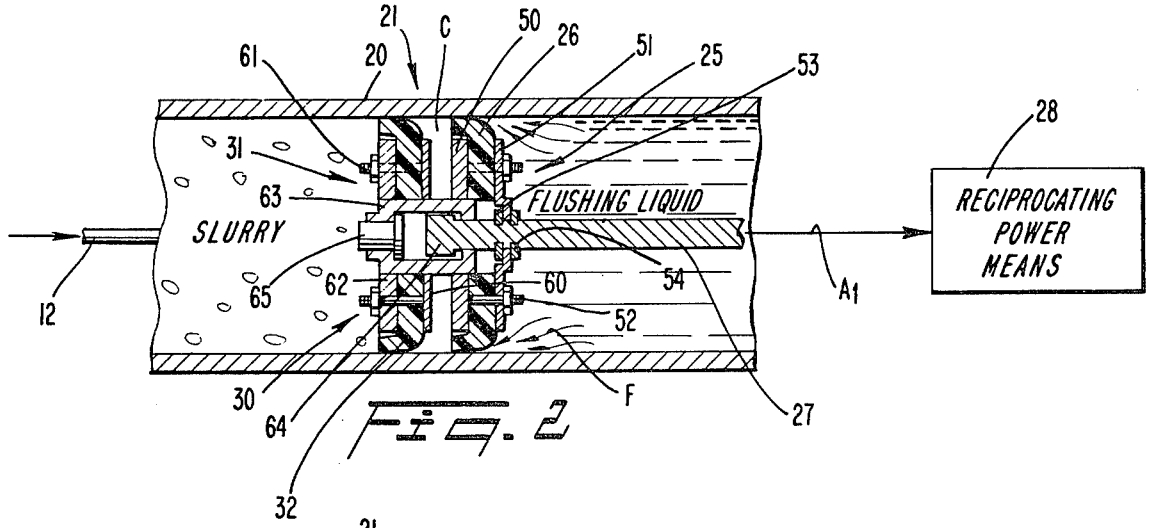
FIG. 2 is a detailed, cross-sectional view of the piston assembly mounted in a cylinder and moving on the return stroke to provide an injection of flushing liquid into the pressurizing chamber.

A second piston 30 is mounted in tandem with the first piston 25, as shown in FIG. 2. The piston 30 includes a coupler, broadly designated by the reference numeral 31, providing limited lost motion with respect to the first piston 25. The lost motion action is important to the broader aspects of the present invention, since this provides for movement of the flushing liquid in the desired manner to prevent wear of the cylinder and seals. The piston 30 includes a peripherally deflected sealing member 32 in the form of a disc substantially identical to the sealing member 26.

To review briefly the operation of the self-flushing piston assembly thusfar described, when the reciprocating power means 28 is moving the piston rod 27 on the return stroke of the pump, the flushing liquid on the non-slurry side of the piston assembly 21 is forced in the direction of the arrows F around the periphery of the sealing member 25 and into a chamber C formed between the pistons 26, 30. The movement of the flushing liquid F results from the second piston 30 lagging behind as the piston rod 27 moves to the right, (see Arrow $A_1$ in FIG. 2). Because the flushing liquid is able to slightly deflect the peripheral edge of the sealing member 26, injection into the chamber C can occur, whereas the slurry is prevented from entering since the pressure against the sealing member 32 simply presses the periphery into tighter engagement with the cylinder wall and prevents entry. Thus, on the return stroke of the pump 10, the chamber C is filled with a predetermined volume of flushing liquid by suction.

Figure 3:
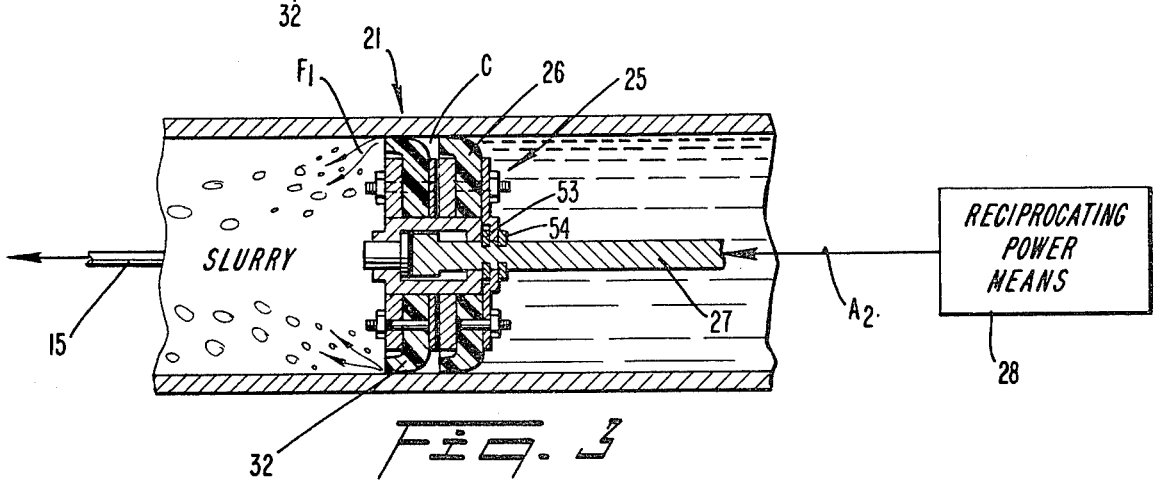
FIG. 3 is a cross-sectional view like FIG. 2 but with the piston assembly moving during a power stroke and with the flushing liquid being ejected so as to remove the particles, as desired.

As best shown in FIG. 3, when the reciprocating power means 28 reverses, the piston rod 27 is moved toward the left (See Arrow $A_2$) causing the first piston 25 to immediately move therewith. This is during the power stroke of the piston assembly 21 thus causing pumping action of the slurry to the pressure line 15 (c.f. FIG. 1). As the piston assembly 21 moves forward, the second piston 30 would tend to accumulate aggregate particles at the periphery where the sealing member 32 engages the cylinder wall. However, as the piston assembly 21 commences to move, the chamber C is compressed causing the flushing liquid $F_1$ to be squeezed past the peripherally deflected sealing member 32 and into the slurry. As this occurs, the aggregate material is advantageously removed from the seal area and the piston assembly 21 is free to move forward with a cleared area around the full periphery. Since the particles have been blown away from the seal area, they cannot lodge at the interface between the seal and the cylinder wall, thus assuring against deleterious wear of both components. The flushing liquid is advantageously ejected in this direction since the liquid cannot move back due to the deflection of the sealing member 26, which simply forms a tighter and tighter seal, as the pressure is increased in the chamber C. The sealing members 26, 32 are selected so as to have sufficient flexibility to allow the flow action as described in accordance with the flow arrows F, F1 (see FIGS. 2 and 3 respectively). In effect, the flushing liquid moves from the flushing liquid reservoir around the sealing member 26 and into the chamber C on the return stroke, as the chamber C is expanding, and then from the chamber C as it is compressed on the power stroke.

In order to insure that the flushing liquid will move past the seal 26 in accordance with the flow arrows F, the pumping system is provided with the liquid through a suitable source, such as clear water source 40 (see FIG. 1). The water is fed through check valve 41 and a pressure control valve 42 along line 43. The pressure control valve 42 is connected to an accumulater 44 having a diaphragm 45. Thus, as the piston rod 27 is moved on the return stroke, the pressure is maintained sufficiently to inject the flushing liquid into the chamber C (FIG. 2) but as the return stroke continues, the accumulater 44 simply fills with the liquid and maintains the pressure substantially constant. Because of this feature, the piston rod 27 does not require extra power to pressurize the liquid. The liquid simply moves to the upper portion of the accumulater 44 by stretching the diaphragm 45 with the pressure being maintained substantially the same. This back pressure thus allows filling of the chamber C while minimizing the drag on the piston rod 27 that would otherwise cause the increased power to be consumed.

In the pumping mode, that is, with the piston assembly 21 moving on a pressure stroke (FIG. 3), the flushing liquid simply moves back from the accumulater 44 and a volume equalled to the chamber C is replenished through the source 40 and check valve 41.

As mentioned above, the sealing member 26 includes a flexible disc (see FIG. 2) which can be fabricated of a suitable rubber or plastic to give the desired sealing qualities with respect to the cylinder 20. As indicated above, the material is selected to allow the required flexibility so that the flushing liquid can be injected into the chamber C and then ejected in order to remove the particles and keep the sealing area for the member 32 clear (see flow arrows F, F1).

The sealing member 26 is clamped between a pair of retainer plates 50, 51 by suitable fasteners 52. The plate 51 is rigidly attached to the piston rod 27 by a pair of lock nuts 53, 54. Thus, as the piston rod 27 is reciprocated, the first piston 25 moves therewith.

Coupler 31 includes an integral plate 60 including fasteners 61 for attaching plate 62. The coupler 31 includes a hollow carrier 63 slidably receiving the end of the piston rod 27. A shoulder 64 is received in the carrier and provides limited reciprocating movement to thereby provide the lost motion required for expanding and compressing the chamber C (FIGS. 2 and 3, respectively). The carrier 63 includes a plug 65 to provide an enclosed structure. Suitable pressure relief ports may be provided (not shown) in the plug 65 and through the plate 51 in order to allow movement of the coupler 31, as desired.

In summary, a piston assembly has been provided, that is, self-flushing and simple in design and concept. The piston's assembly 21 includes a first piston 25 mounted for movement with the piston rod 27 and a second piston 30 mounted for lost motion movement on the same piston rod. As the pistons move with the piston rod 27, relative movement between the two is thus allowed, creating on the return stroke of the assembly 21 a chamber C between the pistons. Flushing liquid fills the chamber C and then on the power stroke is advantageously expelled around the sealing member 32 of the second piston 30 to remove the particles and aggregate material. With this desired action, wear of the cylinder wall and the sealing members is minimized and pumping of slurry is now practical. The drag on the system is minimized by controlling the pressure in the flushing liquid.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the first piston may be strengthened for higher pressure operation and include a sealing member formed of conventional high pressure packing materials. The embodiment was chosen and described to provide the best illustration of the principles of the invention and its practical application to thereby enable one of ordinary skill in the art to utilize the invention and various embodiments and with various modifications as are suited to the particular use contemplated. It is intended that the scope of the invention be defined by the claims appended hereto.

I claim:

1. A piston assembly for mounting in a mating cylinder to form a pump for slurry or the like comprising a first piston including a first peripheral sealing member, reciprocating means for driving said first piston for pumping action within the cylinder, a second piston adjacent said first piston and including a second peripheral sealing member, said second piston forming an enclosed chamber with said first piston and the adjacent portion of said cylinder, means for coupling said second piston to said reciprocating means to provide limited lost motion, and vary the size of said chamber, means for injecting flushing liquid into said chamber during the return stroke of the piston assembly and expansion of said chamber, whereby on the power stroke of the piston assembly said flushing liquid is forced past the second sealing member by contraction of said chamber and into the slurry to remove slurry particles around the periphery of said second sealing member.

2. The piston assembly of claim 1 wherein the sealing members comprise respective first and second flexible discs peripherally deflected toward the slurry side, said injecting means including the peripheral portion of the first disc having sufficient flexibility to allow filling of said chamber with flushing liquid from the cylinder on the non-slurry side during the return stroke.

3. The piston assembly of claim 1 wherein said injecting means includes a flushing liquid source on the non-slurry side filling the cylinder and back pressure control means to permit filling of said chamber with flushing liquid while minimizing the drag on said reciprocating means.

4. The piston assembly of claim 3 wherein said pressure control means includes an accumulator having a flexible diaphragm to receive the flushing liquid during the return stroke.

5. The piston assembly of claim 2 wherein said first piston includes a pair of retainer plates clamping said first disc to said reciprocating means for movement therewith.

6. The piston assembly of claim 5 wherein said reciprocating means comprises a piston rod extending through said cylinder on the non-slurry side, fastener means for connecting said plates together, and a pair of lock means on opposite sides of one of said plates.

7. The piston assembly of claim 6 wherein said coupling means includes a hollow carrier for said second piston and slideably receiving the end of said piston rod, a shoulder on said rod for limited reciprocating movement within said carrier to provide the lost motion.

8. The piston assembly of claim 7 wherein said second piston includes a pair of retainer plates for the second disc, one plate of said second piston being fixed to said carrier, and fastener means for securing the other plate and the second disc.

* * * * *